US010167606B2

(12) United States Patent
Karsten

(10) Patent No.: US 10,167,606 B2
(45) Date of Patent: Jan. 1, 2019

(54) METHOD AND APPARATUS FOR STABILISING A DIKE

(71) Applicant: J.F. Karsten Beheer B.V., Middelie (NL)

(72) Inventor: Johannes Franciscus Karsten, Middelie (NL)

(73) Assignee: J.F. Karsten Beheer B.V., Middelie (NL)

( * ) Notice: Subject to any disclaimer, the term of this patent is extended or adjusted under 35 U.S.C. 154(b) by 507 days.

(21) Appl. No.: 14/410,639

(22) PCT Filed: Jun. 28, 2013

(86) PCT No.: PCT/NL2013/050466

§ 371 (c)(1),
(2) Date: Dec. 23, 2014

(87) PCT Pub. No.: WO2014/003564

PCT Pub. Date: Jan. 3, 2014

(65) Prior Publication Data

US 2015/0191888 A1 Jul. 9, 2015

Related U.S. Application Data

(60) Provisional application No. 61/764,086, filed on Feb. 13, 2013, provisional application No. 61/665,367, filed on Jun. 28, 2012.

(30) Foreign Application Priority Data

Jun. 28, 2012 (NL) ..... 2009075
Feb. 6, 2013 (NL) ..... 2010257

(51) Int. Cl.
*E02D 27/50* (2006.01)
*E21D 21/00* (2006.01)
(Continued)

(52) U.S. Cl.
CPC ..... *E02D 27/50* (2013.01); *E02B 3/12* (2013.01); *E02D 17/18* (2013.01); *E02D 17/20* (2013.01);
(Continued)

(58) Field of Classification Search
CPC ..... E21D 21/00; E21D 21/0026; E21D 2021/0073; E21D 21/008; E21D 20/02;
(Continued)

(56) References Cited

U.S. PATENT DOCUMENTS 287,923 A * 11/1883 Gorla ..... E04H 12/2215 52/154
1,606,146 A * 11/1926 Cole ..... E02D 5/803 52/161
(Continued)

FOREIGN PATENT DOCUMENTS

DE 3816271 A1 12/1988
DE 4017710 A1 9/1991
(Continued)

OTHER PUBLICATIONS

International Search Report, dated Oct. 29, 2013, from corresponding PCT application.

*Primary Examiner* — Benjamin F Fiorello
*Assistant Examiner* — Edwin J Toledo-Duran
(74) *Attorney, Agent, or Firm* — Lindsey A. Auerbach; Catherine A. Shultz; N.V. Nederlandsch Octrooibureau

(57) ABSTRACT

A method of stabilizing a dike using a ground anchor assembly, includes: connecting a ground anchor to a first end of a tensile member; introducing the ground anchor through the earth body and into a stable layer beneath the dike; providing a pressure distributing member on or around the tensile member at a position within the dike where stabilization against lateral earth movement is required; and con-
(Continued)

necting a second end of the tensile member to a counter member at an outer surface of the dike.

41 Claims, 4 Drawing Sheets

(51) Int. Cl.
*E02D 29/02* (2006.01)
*E02B 3/12* (2006.01)
*E02D 17/18* (2006.01)
*E02D 17/20* (2006.01)
*E02D 27/40* (2006.01)

(52) U.S. Cl.
CPC ..... *E02D 17/207* (2013.01); *E02D 27/40* (2013.01); *E02D 29/0233* (2013.01)

(58) Field of Classification Search
CPC ..... E21D 20/023; E21D 20/026; E02D 29/02; E02D 29/0225; E02D 29/0233; E02D 29/0241
USPC ..... 405/259.1–262, 284–287
See application file for complete search history.

(56) References Cited

U.S. PATENT DOCUMENTS 2,121,757 A * 6/1938 Heinrich ..... E02D 5/803 52/160
3,302,347 A * 2/1967 Jackson ..... E02D 5/805 52/154
3,736,711 A * 6/1973 Thornbrugh ..... E02D 5/801 52/149
3,772,838 A * 11/1973 Virnig ..... E02D 5/805 52/160
4,247,223 A * 1/1981 Amakasu ..... E21D 21/008 405/259.1
4,530,190 A * 7/1985 Goodman ..... E02D 5/80 175/23
4,610,568 A 9/1986 Koerner
4,983,076 A * 1/1991 Vidal ..... E02D 29/0241 405/262
5,017,049 A 5/1991 Sievert
5,372,457 A * 12/1994 Rante ..... E02B 11/005 248/87
5,468,098 A * 11/1995 Babcock ..... E02D 29/0225 405/262
5,524,855 A * 6/1996 Lesar ..... E04H 12/2215 135/16
5,531,547 A * 7/1996 Shimada ..... E02D 29/0241 405/262
5,551,810 A * 9/1996 Franceski ..... E02D 29/0225 405/262
5,823,133 A * 10/1998 Mele ..... B63B 21/44 114/301
6,238,144 B1 * 5/2001 Babcock ..... E02D 29/0283 405/262
6,349,514 B1 * 2/2002 Adams ..... A01G 9/122 135/118
6,524,027 B1 2/2003 Fabius
6,874,975 B2 * 4/2005 Hilfiker ..... B21C 37/20 405/262
7,823,347 B1 * 11/2010 Blinn ..... B66C 23/62 182/186.7
2002/0088186 A1 * 7/2002 Cusimano ..... E02D 5/805 52/162
2004/0202512 A1 * 10/2004 Smith ..... E02D 5/80 405/259.1
2004/0213636 A1 * 10/2004 Russell ..... E02D 3/10 405/184.4
2005/0103252 A1 * 5/2005 Brunning ..... B63B 21/26 114/295
2005/0232700 A1 * 10/2005 Timmerman ..... E02D 5/765 405/31
2008/0044558 A1 * 2/2008 Fields ..... B44D 2/002 427/136
2008/0282625 A1 11/2008 Stahm
2009/0041548 A1 2/2009 Stahm
2009/0260315 A1 * 10/2009 Hodge ..... E02D 3/02 52/698
2012/0298291 A1 * 11/2012 Smith ..... E04C 5/07 156/242
2013/0175017 A1 * 7/2013 Goto ..... B21D 11/14 165/181

FOREIGN PATENT DOCUMENTS

DE 19748660 5/1999
EP 2354323 A1 8/2011
GB 2116222 A 9/1983

* cited by examiner

METHOD AND APPARATUS FOR STABILISING A DIKE

BACKGROUND OF THE INVENTION

The present invention relates to a method of stabilizing an earth body such as an embankment or dike and, in particular, to a ground anchor assembly for performing the method.

DE4017710A1 relates to dike improvement.

US 2008/0282625 A1 discloses in general a pivoting ground anchor, also referred to as earth anchor.

U.S. Pat. No. 4,610,568 (A) relates to a system and method for stabilizing the potential slip zone of a slope, and, in particular, to the use of anchored geosynthetic fabrics for effecting slope stabilization. The disclosed anchor does not retain ground between its ends.

Dikes and embankments have been extensively used for millennia for various purposes, including water retention, road construction and the like. In the following, reference to dikes is intended to cover raised earth bodies in the broadest sense, including dikes, embankments, dams, levies and the like and is not intended to be limiting to sea and river defences. Depending on the local soil conditions, various techniques have been used to construct and stabilize such earth bodies. In particular, dikes made of sand and similar material are difficult to stabilize without additional support. Dikes, especially those comprising a core of turf-like material tend to compact and expand depending on the weather conditions. After elongated periods of rain or drought or in the case of raised water level in, under and behind the dike, migration of earth material can occur, resulting in weakening of the dike. A characteristic of most such constructions is the tendency for shear to occur within the dike body. Any weight on an upper portion of the dike tends to bear downwards, tending to subsidence if no action or provision is taken to prevent this. This is particularly problematic in the case that new construction is required on top of or against the dike or if the dike is to be increased in height.

Previous procedures for stabilizing existing dikes have involved the introduction of anchors through the dike and into the stable earth layers therebelow. These anchors have then been grouted into place using a cement or concrete construction. A disadvantage of such an approach is that the dike becomes more rigid and is unable to swell and contract with the climate without relative movement occurring between the concrete and the core of the dike. Other procedures have involved the formation of concrete and steel dam constructions, vertically into the ground beneath. Although this may lead to a strong and stable structure, it comes at significant expense and the result is to all intents and purposes a retaining wall rather than a traditional dike.

It would be desirable to provide a device that can be used for stabilizing of dikes in a cost effective manner.

BRIEF SUMMARY OF THE INVENTION

According to the invention there is provided a ground anchor assembly for stabilizing a dike, comprising a ground anchor, a counter member and an elongate tensile member connecting the ground anchor and the counter member. The tensile member is provided between the ground anchor and the counter member with a pressure distributing member, arranged to prevent earth flow in a direction perpendicular to a length direction of the tensile member. In this manner, by providing the tensile member with a pressure distributing member, flow of earth in a direction perpendicular to the tensile member may be reduced or prevented. Depending on the embodiment of the tensile member also flow in other directions is reduced or prevented.

In contrast to existing anchor arrangement that can only be subjected to tensile forces, according to the invention flow loading of the tensile member occurs, preventing lateral flow of earth material within the dike that could lead to subsidence. The pressure distributing member acts as a flow restricting means and distributes the forces acting in different earth layers. In dike bodies it has been observed that depending on the water level in, under or behind the dike and also the constitution of the dike material it is possible that on different levels different lateral forces may act. The same may apply in relation to changes in loading on the dike.

If an earth body such as a dike would only be stabilized by "clamping" the earth material between a ground anchor and a counter member, lateral migration of earth which can be promoted by water resulting in a flowable slurry, cannot be prevented. According to the invention such lateral flow can be considerably reduced.

It should also be understood that flow of earth material can be in a non-horizontal plane. This depends on the build-up of the different layers of the dike and the way in which the dike is subjected to water and draining of such water.

It will also be appreciated that ground anchors are generally known in the art and used for many purposes. One particular use of such anchors is for applying tension to a sheet piling wall. In such situations however the action of the anchor is purely in tension and there is no requirement of any resistance against lateral forces or flows.

According to a preferred embodiment, the pressure distributing member is elongated and extends along the tensile member, preferably over at least 10% of its length, more preferably over at least 30% of its length. It may also extend over substantially the whole of its length. In general, it may be expected that the pressure distribution member extends over between 20% and 50% of the length of the tensile member but this may depend on the actual length of the tensile member compared to the length of the portion requiring stabilisation. For very long tensile member of e.g. 25 m in length the portion over which the pressure distribution member extends may be less than 10%. In general, the pressure distribution member cover at least 1 m. It will be understood that a plurality of pressure distribution members may be provided on a single tensile member e.g. spanning different zones of possible slip. The location of these zones may be determined by geotechnical surveys of the dike.

The pressure distributing member can be embodied in several ways in order to optimize its function to restrict displacement of earth material. Preferably the pressure distributing member has a relatively large surface to be as effective as possible. Preferably the pressure distribution member has a width or diameter of at least 7 cm, more preferably at least 10 cm and most preferably at least 15 cm. According to one preferred embodiment, the pressure distributing member is embodied as a bladed structure. Particularly such bladed structure may be centered around the elongated tensile member. According to another preferable embodiment the pressure distributing member may be integral with the tensile member. In an embodiment, the pressure distributing member is a plastic or a metal strip. It is possible to use one and the same material for both the pressure distributing member and the tensile members. For the pressure distributing member, such materials may include metals, preferably corrosion resistant or treated metals, composite materials including fibre composites, ceramic materials, plastics and the like. A particularly suitable material is basalt epoxy composite, as this is not subject to corrosion.

The tensile member may be a rod, a cable a rope or any other suitable member capable of supporting the required loads. The tensile member may have any required length for insertion through the dike to the required anchor location. Most preferably it will have a minimum length of 3 m. It may comprise any of the materials mentioned above, subject to adequate tensile strength. One particularly suitable material is based on a basalt fibre composite material. This can be provided on a reel and cut to length for the production of ground anchor assemblies in-situ. Other materials may also be used in this way. At the place of installation, parts of the tensile member/earth flow restricting means are taken from the reel and connected to the ground anchor. After that the ground anchor is introduced in the soil after which the other end of the tensile member/earth flow restricting means is connected to the counter member. It is also possible to effect separation of the tensile member/earth flow restricting means from the end on the reel only after the ground anchor together with the tensile member/earth flow restricting means have been entered in the dike.

The invention also relates to an dike comprising a number of adjacently arranged ground anchor assemblies, wherein each ground anchor assembly comprises a ground anchor to be introduced in an dike, a counter member and an elongate tensile member, connecting said ground anchor and said counter member, wherein said tensile member is provided between said ground anchor and said counter member with a pressure distributing member arranged to prevent earth flow in a direction perpendicular to the length direction of said tensile member wherein the pressure distributing member is arranged to restrict the flow. Through the use of a number of ground anchor assemblies having pressure distributing members a possible flow path for earth material can be effectively blocked. It will be appreciated that such ground anchor assemblies may be inserted in any direction through the dike, including vertically and horizontally and from any angle from a front side or rear side of the dike. It is also conceivable that the tensile member may extend right through the dike and in which case the ground anchor may be embodied as a second counter plate or another form of counter member.

The counter member can be arranged in any position. i.e. below ground level or at ground level. According to a preferred embodiment the counter member comprises a perforated plate which may be made of plastic material such as is used for parking spaces where grass growth through the plate is required. It is also possible to embody the counter member as a geonet, i.e. a net of geomaterial. Grass and vegetation on the dike is understood to be advantageous in reducing erosion. The counter member may also be made from concrete, metal, composite materials and the like. In particular, the above-mentioned basalt composite material is particularly suitable.

It has been found that the pressure distributing member may engage the ground such that a counter member is not strictly required. The distributing member itself then at least partly functions as a counter member and ground is retained between the ground anchor and the pressure distributing member. It will be clear that in this case the pressure distributing member is fixed to the tensile member.

The invention also relates to a method for stabilizing a dike using a ground anchor assembly, the method comprising: connecting a ground anchor to a first end of a tensile member; introducing the ground anchor through the dike and into a stable layer; providing a pressure distributing member on or around the tensile member at a position within the dike where stabilisation against lateral earth movement is required; and connecting a second end of the tensile member to a counter member at an outer surface of the dike. In this context, a stable layer is intended to denote a layer that is not subject to lateral slip and that is adequate for providing the required tension force. This layer may be the underlying clay layer beneath the dike or a stable core, not subject to slip.

Although it is possible to install the ground anchor assembly in any possible way, according to a preferred embodiment of the invention the ground anchor is pivotable around the end of the tensile member. In this manner it may be positioned parallel to the tensile member during introduction and tilted by around 90° once located at the anchoring position. This can be realized by applying tension to the tensile member when the ground anchor is in the desired position. Relatively rigid tensile members can be inserted by pushing in the direction of introduction. If necessary an additional pusher rod could be used for inserting the tensile member to the desired position. The pusher rod can be vibrated using otherwise conventional equipment. The pressure distributing member may be introduced together with the ground anchor and tensile member or may be inserted over it at a later stage once the anchor is in position. The pressure distributing member may then be fixed to the tensile member to prevent further sliding or migration within the dike.

According to a further aspect of the invention this is realized with a method for stabilizing an earth body, like a dike, embankment, dam etc., comprising the steps;

- providing a plurality of mechanical ground anchor assemblies, each assembly comprising a ground anchor and a flexible tension member for coupling the ground anchor to an object to be anchored, as well as a coupling member which fixedly couples the anchor to the tension member,
- installing a mechanical ground anchor of the plurality of assemblies through the earth body in a respective anchor location at least 0.5 meter below the earth body surface for stabilizing the earth body,
- applying a geonet, like geotextile, to the earth body for ground stabilization,
- coupling the flexible tension member, associated with the mechanical ground anchor of the plurality of assemblies, with the geonet for maintaining the earth body.

The tension member being flexible in conjunction with the geonet allows the geonet to follow natural swell and shrink of the earth body and allows subsidence while still maintaining connection of the earth body. Also, the earth body is strengthened with respect to sliding off of a layer of sand from the earth body because the earth body is maintained between the anchor and the geonet. A thus strengthened dike, allows a more steep and/or high dike construction with a smaller footprint which is beneficial in densely populated area. In addition, the method maintains connection of the earth body without need of manoeuvring heavy equipment on the earth body because operations can be performed from sidewards with respect to the earth body.

Stabilizing an earth body has to be understood such that the entire earth body is stabilized. This is distinct from erosion control wherein a relative thin outer layer of a dike body is given connection to allow growth of vegetation. This is disclosed in for example in DE4017710A1. Likewise, in U.S. Pat. No. 6,524,027 there is provided a method for stabilizing soil for erosion control, said method comprising:

penetrating a plurality of soil nails into the soil; and establishing vegetation adjacent a top surface of the soil, the vegetation being arranged to generate roots which penetrate through the surface into the soil. Such a soil nail does retain soil between its ends.

It will be understood that according to the invention the geonet, which is known per se, has a strength such that loads in connection with stabilizing the earth body can be accommodated.

Flexible has to be understood such that the tension member is easily bendable such that natural swell and shrink of the earth body as well as limited sliding off of a layer of sand can be accommodated while maintaining the stabilizing of the earth body. It will be understood that where a ground anchor is mentioned, any other suitable resistance element, that provides anchoring capacity in an earth body, is conceivable.

In an embodiment the method comprises repeating the steps;

installing a mechanical ground anchor of the plurality of assemblies through the earth body in a respective anchor location at least 0.5 meter below the earth body surface for stabilizing the earth body, coupling the flexible tension member, associated with the mechanical ground anchor of the plurality of assemblies, with the geonet for maintaining the earth body, for each respective ground anchor of the plurality of ground anchors. This even more maintains connection of the earth body.

In an embodiment of the method, the mechanical ground anchor is a pivoting ground anchor and the method comprises the step;

setting the pivoting ground anchor in its anchor position upon taking in of the flexible tension member.

In an embodiment of the method, adjacent tension members are coupled with the geonet at a mutual tension member spacing in the range of 0.1 meter to 10 meter. This even more maintains connection of the earth body. As an example the tension member spacing is about 1 meter.

In an embodiment of the method, the tension members are coupled with the geonet along a pattern like a line-, check- or any other suitable pattern. This provides an evenly distributed way of maintaining connection of the earth body.

In an embodiment of the method, the tension member is a flexible strip made of woven or non-woven fabric suitable for coupling with the geonet. The tension member may be a strip of geonet. It is conceivable that the tension member is fibre reinforced plastic rod (FRP) or any other rod or tension bar. Any suitable flexible tension member will suffice as long as the flexibility is such that natural swell and shrink of the earth body can be accommodated.

In an embodiment of the method, the tension member is a plastic or a metal strip. The tension member being a strip even more provides the earth body an improved shear resistance to prevent sliding off of a layer of sand. The strip may even extend along a helical plane which strip then even more engages with the earth body and provides an even more improved shear resistance.

In an embodiment of the method, the coupling of the tension member with the geonet comprises weaving of the tension member with the geonet, clamping of the tension member with the geonet, and/or hooking of the tension member into the geonet. This allows a fast coupling of the tension member with the geonet.

In an embodiment, the method comprises the step;

installing mechanical ground anchors of the plurality of assemblies through the earth body from opposite sides of the earth body for stabilizing the earth body.

This even more strengthened dike allows to provide a dike with an even more increased slope of a dike and in connection therewith a narrow base of foot of said dike which is beneficial when room is restricted. It is conceivable that mechanical ground anchors are applied from the top of the earth body with the tension member extending upwards.

In an embodiment of the method, installing the ground anchor comprises driving of the ground anchor with a driving rod coupled with the ground anchor by a driving rod coupling member for temporary coupling the anchor with the driving rod to drive the anchor to the anchor location, wherein the method comprises the step filling of the space left by the driving rod with a filler like grout, bentonite or any other suitable filling material, upon retracting the driving rod after the ground anchor has been installed in its respective anchor location. This prevents weakening of a dike since space left is immediately filled.

In an embodiment of the method the driving rod comprises a conduit which extends in the longitudinal direction of the driving rod, and wherein the conduit is provided with a discharge at is leading end, and the filling of the space left by the driving rod comprises supplying of the filler through the conduit.

In an embodiment of the method length l of the tension member exceeds 0.5 meter, preferably exceeds 3 meter. In practice, the tension member may have a length of tens of meters like 30 meter or whatever is needed to reach a strong enough layer of sand below the earth body. The tension member may be supplied from reel in order to speed up operations even more. This supply from reel is even more possible because of the flexibility of the tension member.

In an embodiment of the method the length (l) of the tension member is such that the anchor location below the earth body surface is at a separate earth layer distinct from the earth body. This even more maintains connection of the earth body while making use of the foundation offered by a layer below the earth body.

In an embodiment of the method, the tension member is of one piece.

In an embodiment of the method, the tension member is continuous.

The invention will be further elucidated referring to preferred embodiments shown in the drawing in which:

FIG. 1 shows schematically a ground anchor assembly according to the invention;

FIG. 1*a* is a detail of FIG. 1;

Figure 1A:
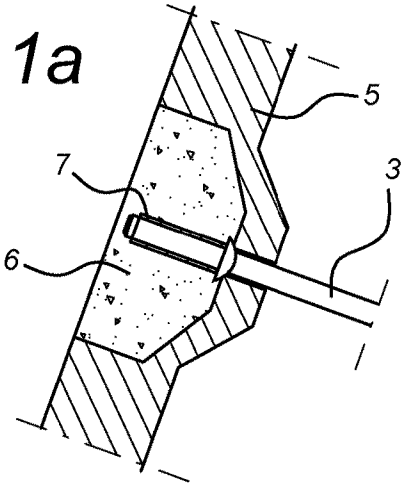
Figure 1:
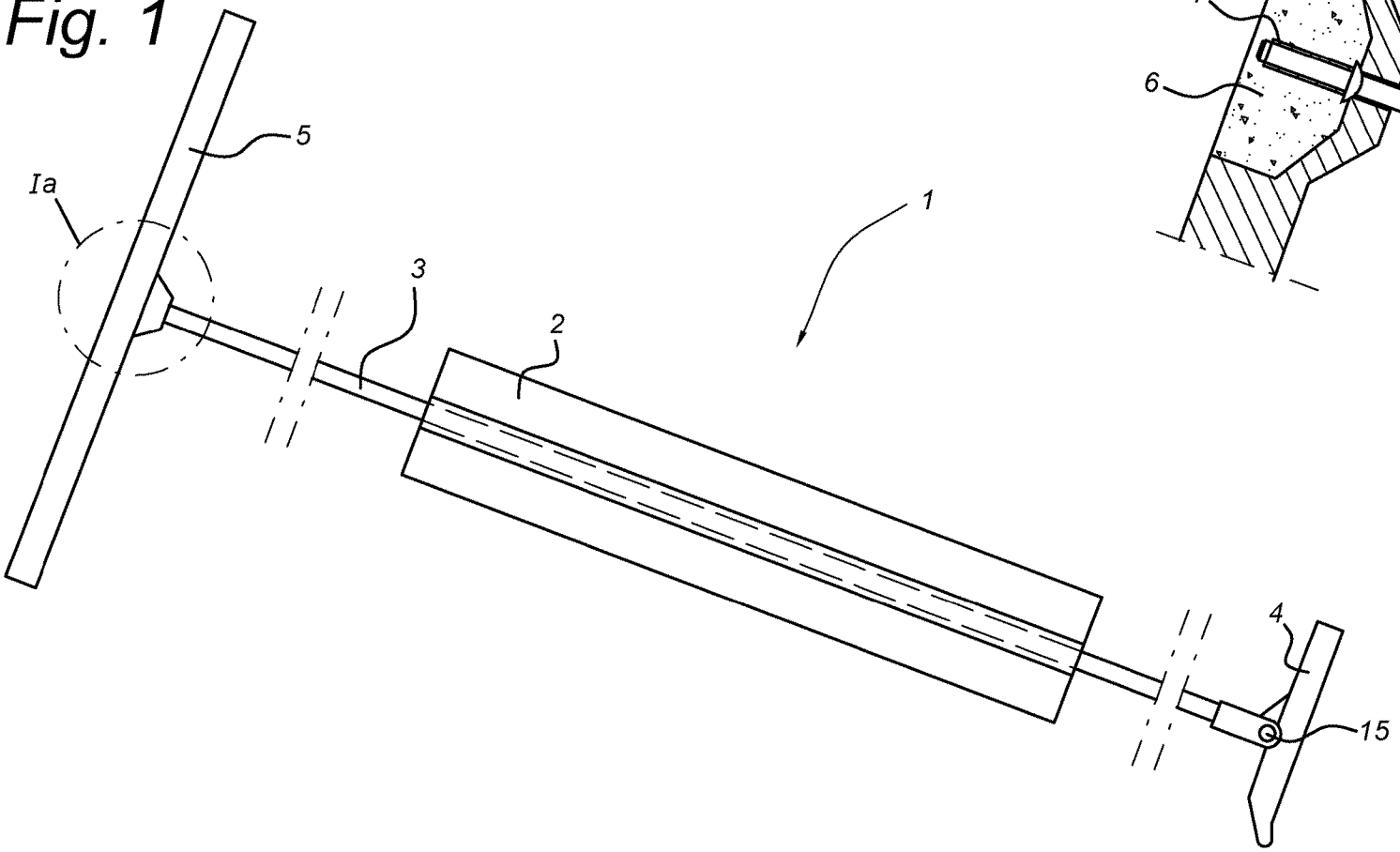

In FIG. 1 a ground anchor assembly according to the invention is generally shown at 1. It comprises a ground anchor 4 having a pivot 15 for connection to a tensile rod 3. A substantial part of tensile rod 3 is provided with a pressure distributing member 2. Remote from the ground anchor 4 a counter plate 5 is provided. In FIG. 1*a* connection of the counter plate 5 and the tensile rod 3 is shown. A clamping sleeve 7 is provided over tensile rod 3 and crimped thereto. Thereafter an epoxy sealing material 6 is introduced in the cavity in which clamping sleeve 7 is arranged to make the assembly vandal proof. It will be understood that alternative fixations may be provided instead of the clamping sleeve, including screw fixation and adhesives, depending on the material of the tensile member. Other materials may be used for encasing the fixation member. Such clamping action can be effected after inserting the ground anchor 4 to the desired position and tensioning the tensile rod 3 to the desired value.

Figure 2:
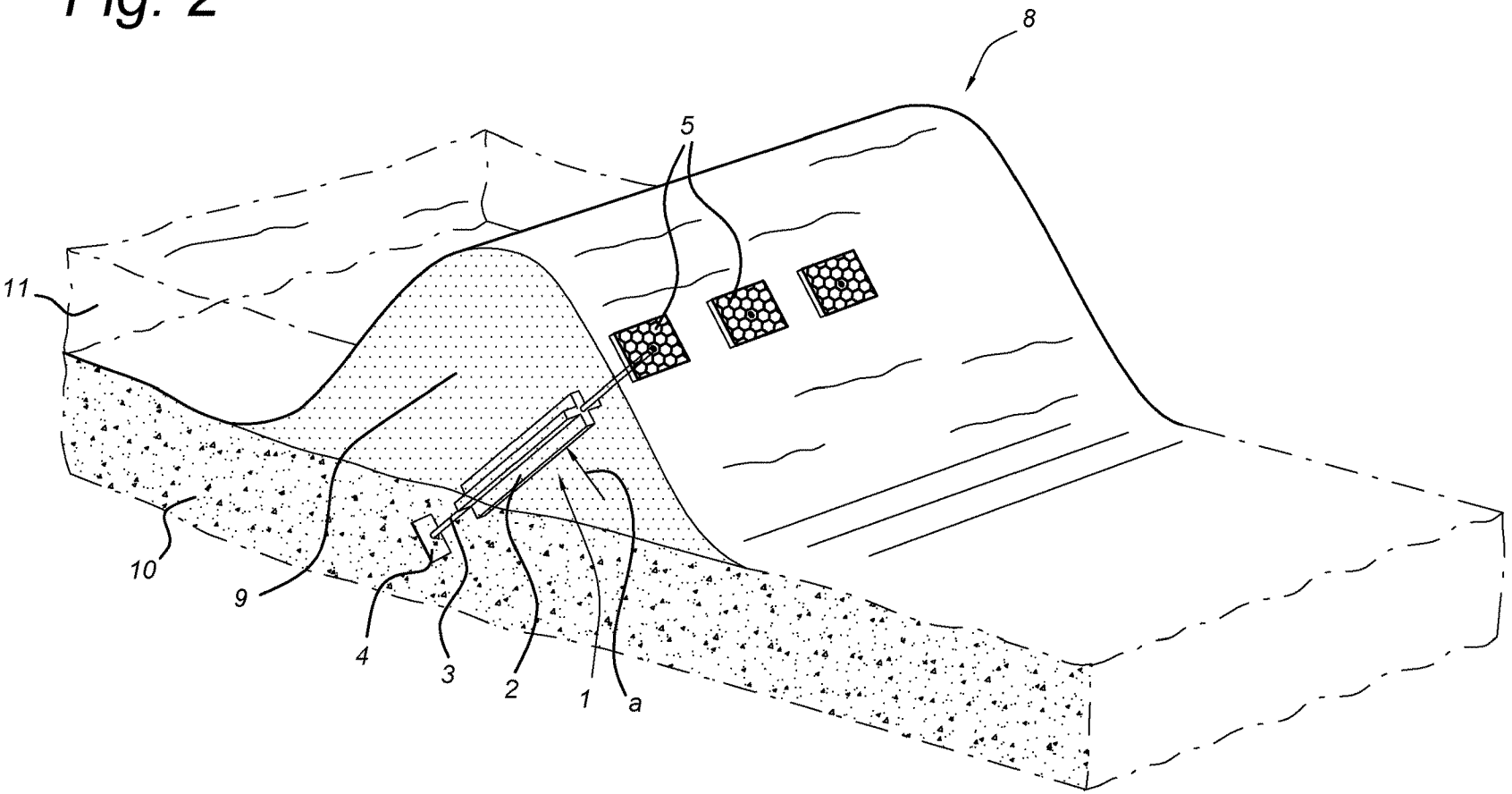
FIG. 2 is partial cross section through a dike according to the invention.

In FIG. 2 an example is given wherein the final condition after mounting a ground anchor assembly is shown. FIG. 2 shows that the counter member 5 is embodied as a plate having perforations. It should be understood that counter member 5 can have any configuration according to the related requirements. It is also clear from FIG. 2 that counter plate 5 is at the surface of the dike 8. It should be understood that it can also be provided below the surface thereof. Dike 8 is arranged above the original soil layer 10 and comprises an earth core 9. One side of the dike 8 is subjected to pressure from water 11 whilst the other side thereof should remain dry. By placing a number of ground anchor assemblies 1 as shown in FIG. 2 adjacent to each other in length direction and having the ground anchor 4 extending into the original soil the position of the earth core 9 is fixed in normal conditions.

However due to rain or other particular circumstances it might be possible that the moisture content in the dike becomes so high that flow of earth material is possible resulting in removal of earth material between ground anchor 4 and counter plate 5. This results in lowering of the stabilization force from counter plate 5 on the body of earth such that the effectiveness of such an anchor assembly is greatly reduced. According to the invention by using pressure distributing member 2 movement of earth is substantially prevented. By placing a number of ground anchor assemblies adjacent to each other occurrence of a flow of earth material is blocked.

In FIG. 2, arrow a shows a flow direction perpendicular to the tensile rod 3. It should be understood that other flows, for example horizontal flows, are also prevented.

Figure 4:
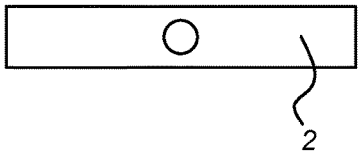
FIG. 4-6 show cross sectional views of several embodiments of the pressure distributing member.
Figure 5:
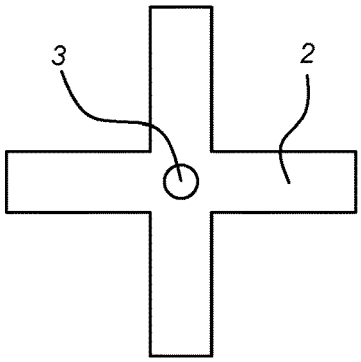
Figure 6:
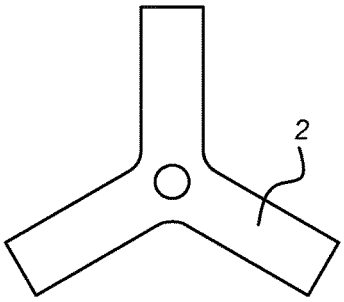

In FIG. 2 the pressure distributing member 2 is shown as having a cross shape in cross-section. This is further shown in FIG. 5. FIG. 4 shows the pressure distributing member 2 embodied in the form of a strip. FIG. 6 shows the pressure distributing member 2 in the form of a three bladed shape. It will be understood that these shapes are merely exemplary and that any other suitable cross-section may be provided that increases the surface area for the prevention of lateral flow. The pressure distributing member 2 may also be spiralled along the length of the tensile member and that other shapes are possible. It is also possible that the shape thereof is not the same over the length thereof but might vary according to the requirements set which depend from the constitution of the several ground layers and the probability of lateral movement.

Figure 3:
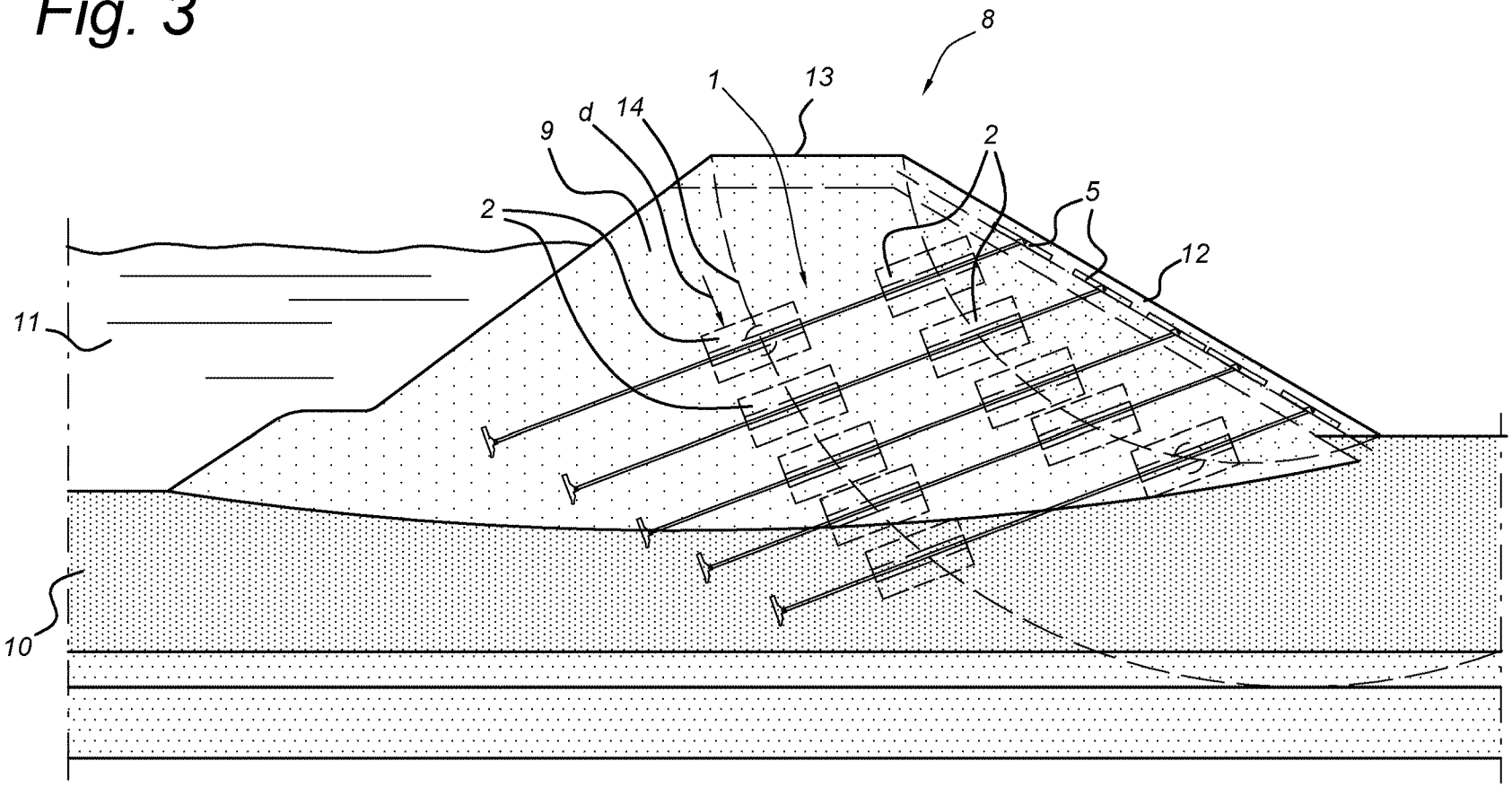
FIG. 3 is an arrangement of a number of ground anchor assemblies according to the invention.

FIG. 3 shows a further example of a dike 8 having a top surface 13 and earth core 9. In this embodiment 14 shows possible slip lines. Portions of the dike can slide with respect to each other under unfavourable circumstances in the direction of arrows d along these slip lines 14. The location of these slip lines 14 or planes can be determined through geotechnical surveying of the dike. Through the presence of the ground anchor assemblies 1 according to the invention and more particular the pressure distributing members 2 such migration can be effectively prevented. In the FIG. 3 embodiment the ground anchor assemblies 1 are placed at numerous elevations within the dike 8 and each tensile member 3 carries two pressure distribution members 2 located such as to span a respective slip line 14.

Figure 7:
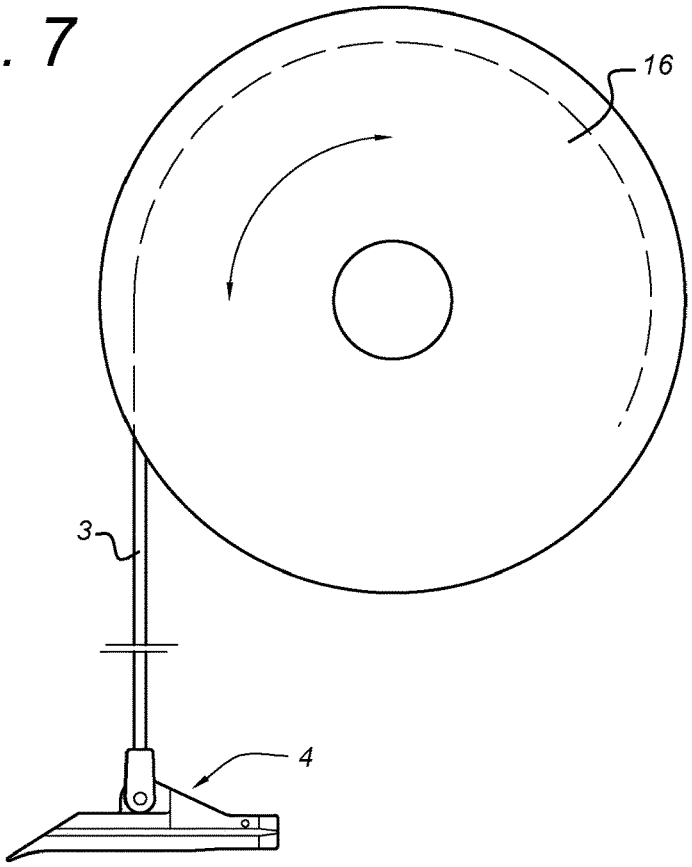
FIG. 7 shows a schematic view of a reel of tensile member attached to a ground anchor.

FIG. 7 shows a reel 16 on which a length of material is provided comprising a flexible tensile member 3 formed of basalt based material. In use, the tensile member 3 can be threaded through the pressure distributing member 2 and connected by a crimped connecting sleeve (not shown) to a ground anchor 4. The ground anchor 4 is then inserted into the dike to the required depth using a conventional push rod and vibratory driver which drive both the ground anchor 4 and the pressure distributing member 2 into the dike. Once the required depth is reached, the ground anchor 4 is pivoted to its anchoring position by applying a pulling force on the tensile member 3. This can then be cut to the required length after which counter member 5 can be connected using the clamping sleeve 7 shown in FIG. 1*a*.

In an alternative embodiment it is possible to first insert the ground anchor together with the tensile member and subsequently slide flow restrictor 2 over the tensile member 3 to the required depth. It is also possible to introduce a hardening or non-hardening stabilizing material into the body of earth before, during or after introduction of tensile member 3, in particular to fill any voids created during insertion and prevent channel forming along the tensile member.

It should be realized that the above are only examples of the invention. Furthermore it should be clear that combinations can be made with other techniques resulting in further effectiveness of stabilization. For example it is possible that the counter plate is embodied as geonet, such as a geotextile.

Starting from this disclosure, many more embodiments will be evident to a skilled person, which are within the scope of protection and the essence of this invention and which are obvious combinations of prior art techniques and disclosure of this invention.

The invention claimed is:

1. A ground anchor assembly for stabilizing a dike, comprising a ground anchor, a counter member and an elongate tensile member, connecting the ground anchor and the counter member, wherein said tensile member is provided between the ground anchor and the counter member with one or more pressure distributing members centered around the tensile member and arranged to prevent earth flow in a direction perpendicular to a length direction of the tensile member, wherein the one or more pressure distributing members comprise three solid blades extending from the tensile member.

2. The assembly according to claim 1, wherein the one or more pressure distributing members are elongated and extend along the tensile member.

3. The assembly according to claim 1, wherein the one or more pressure distributing members are slideably mounted around the tensile member.

4. The assembly according to claim 1, wherein the one or more pressure distributing members are integral with the tensile member.

5. The assembly according to claim 1, wherein the one or more pressure distributing members comprise a composite material.

6. The assembly according to claim 1, wherein the one or more pressure distributing members are a plastic or a metal strip.

7. The assembly according to claim 1, wherein the ground anchor is a pivotable ground anchor that can be inserted into the dike by an insertion rod and pivoted into position by applying tension to the tensile member.

8. The assembly according to claim 1, wherein the tensile member is a flexible composite rod, secured to the ground anchor and to the counter member.

9. The assembly according to claim 1, wherein the counter member is a perforated plate.

10. The assembly according to claim 1, wherein the counter member comprises a net.

11. A dike comprising a number of adjacently arranged ground anchor assemblies according to claim 1, arranged to prevent earth flow in a direction (a) perpendicular to the length direction of the tensile member.

12. The dike according to claim 11, wherein the counter member is provided near an outer surface of the dike.

13. The assembly according to claim 1, wherein the one or more pressure distributing members are elongated and extend along at least 10% of the length of the tensile member.

14. The assembly according to claim 1, wherein the one or more pressure distributing members are elongated and extend along at least 30% of the length of the tensile member.

15. The assembly according to claim 1, wherein the one or more pressure distributing members comprise a basalt epoxy composite.

16. The assembly according to claim 1, wherein the tensile member is a flexible basalt fibre composite rod, secured to the ground anchor and to the counter member.

17. The assembly according to claim 1, wherein the counter member is a perforated plate of basalt composite.

18. A method for stabilizing a dike using a ground anchor assembly, the method comprising:

connecting a ground anchor to a first end of a tensile member;

introducing the ground anchor through the dike and into a stable layer beneath the dike;

providing a pressure distributing member on or around the tensile member at a position within the dike where stabilisation against lateral earth movement is required, wherein the pressure distributing member comprises three solid blades centered around and extending from the tensile member; and connecting a second end of the tensile member to a counter member at an outer surface of the dike.

19. A method according to claim 18, wherein the pressure distributing member is introduced together with the ground anchor and tensile member.

20. A method according to claim 18, wherein introducing the ground anchor comprises pivoting the ground anchor relative to the tensile member to engage with the stable layer.

21. A method according to claim 18, wherein the counter member is connected to the tensile member with a pretension.

22. A method according to claim 18, further comprising performing a geotechnical survey of the dike and positioning the pressure distributing member at a position corresponding to a slip zone within the dike.

23. A method for stabilizing an earth body, comprising the steps:

providing a plurality of mechanical ground anchor assemblies, each assembly comprising a ground anchor and a flexible tension member for coupling the ground anchor to an object to be anchored, as well as a coupling member which fixedly couples the anchor to the tension member, and one or more pressure distributing members centered around the tension member, the one or more pressure members each comprising two or more solid blades extending around the tension member, installing a ground anchor of the plurality of mechanical ground anchor assemblies through the earth body in a respective anchor location at least 0.5 meter below the earth body surface for stabilizing the earth body, applying a geonet, to the earth body for ground stabilization, coupling the flexible tension member, associated with said one ground anchor of the plurality of mechanical ground anchor assemblies, with the geonet for maintaining the earth body.

24. The method according to claim 23, comprising repeating the steps:

installing one ground anchor of the plurality of mechanical ground anchor assemblies through the earth body in a respective anchor location at least 0.5 meter below the earth body surface for stabilizing the earth body, coupling the flexible tension member, associated with said one ground anchor of the plurality of mechanical ground anchor assemblies, with the geonet for maintaining the earth body, for each respective ground anchor of the plurality of mechanical ground anchor assemblies.

25. The method according to claim 23, wherein the ground anchor of the plurality of mechanical ground anchor assemblies is a pivoting ground anchor and the method comprises the step:

setting the pivoting ground anchor in an anchor position upon taking in of the flexible tension member.

26. The method according to claim 24, wherein adjacent tension members are coupled with the geonet at a mutual tension member spacing in the range of 0.1 meter to 10 meter.

27. The method according to claim 24, wherein a tension member spacing is about 1 meter.

28. The method according to claim 26, wherein the tension members are coupled with the geonet along a pattern.

29. The method according to claim 23, wherein the tension member is a flexible strip made of woven or non-woven fabric suitable for coupling with the geonet.

30. The method according to claim 23, wherein the tension member is a plastic or a metal strip.

31. The method according to claim 23, wherein the coupling of the tension member with the geonet comprises at least one of weaving of the tension member with the geonet, clamping of the tension member with the geonet, and hooking of the tension member into the geonet.

32. The method according to claim 23, comprising the step:

installing each of the mechanical ground anchors of the plurality of mechanical ground anchor assemblies through the earth body from opposite sides of the earth body for stabilizing the earth body.

33. The method according to claim 23, wherein installing each ground anchor comprises driving of the ground anchor with a driving rod coupled with the ground anchor by a driving rod coupling member for temporary coupling the anchor with the driving rod to drive the anchor to the anchor location, wherein the method comprises the step filling of the space left by the driving rod with a filler like grout, bentonite or any other suitable filling material, upon retracting the driving rod after the ground anchor has been installed in a respective anchor location.

34. The method according to claim 23, wherein the driving rod comprises a conduit which extends in the longitudinal direction of the driving rod, and wherein the conduit is provided with a discharge at is leading end, and the filling of the space left by the driving rod comprises supplying of the filler through the conduit.

35. The method according to claim 23, wherein the length (1) of the tension member exceeds 0.5 meter.

36. The method according to claim 23, wherein the length (1) of the tension member is such that the anchor location below the earth body surface is at a separate earth layer distinct from the earth body.

37. The method according to claim 23, wherein the tension member is of one piece.

38. The method according to claim 23, wherein the tension member is continuous.

39. The method according to claim 23, wherein the geonet is a geotextile.

40. The method according to claim 28, wherein the pattern is a line pattern or a check pattern.

41. The method according to claim 35, wherein the length (1) of the tension member exceeds 3 meter.

* * * * *